US008807141B2

(12) United States Patent
Breslin et al.

(10) Patent No.: US 8,807,141 B2
(45) **Date of Patent: *Aug. 19, 2014**

(54) CONDITIONING PROCESS FOR TOBACCO AND/OR SNUFF COMPOSITIONS

(75) Inventors: James C. Breslin, Zeeland, MI (US); Scott A. Williams, Greenbrier, TN (US); Jerry B. Eilliot, Nashville, TN (US); Frank Scott Atchley, Midlothian, VA (US); Vernie A. Due, Kansas City, MO (US)

(73) Assignee: U.S. Smokeless Tobacco Company LLC, Richmond, VA (US)

( * ) Notice: Subject to any disclaimer, the term of this patent is extended or adjusted under 35 U.S.C. 154(b) by 122 days.

This patent is subject to a terminal disclaimer.

(21) Appl. No.: 12/719,201

(22) Filed: Mar. 8, 2010
(Under 37 CFR 1.47)

(65) Prior Publication Data

US 2010/0154811 A1 Jun. 24, 2010

Related U.S. Application Data

(63) Continuation of application No. 11/020,563, filed on Dec. 22, 2004, now Pat. No. 7,694,686.

(60) Provisional application No. 60/531,824, filed on Dec. 22, 2003.

(51) Int. Cl.

| | |
|---|---|
| ***A24B 3/18*** | (2006.01) |
| ***A24B 3/12*** | (2006.01) |
| ***A24B 3/10*** | (2006.01) |
| ***A24B 15/18*** | (2006.01) |

(52) U.S. Cl.
CPC ... *A24B 3/12* (2013.01); *A24B 3/10* (2013.01); *A24B 15/18* (2013.01)
USPC ..... 131/296; 131/299; 131/300; 131/301; 131/306; 131/290

(58) Field of Classification Search
CPC ..... A24B 3/10; A24B 3/12; A24B 15/18; A24B 3/02; A24B 3/06
USPC ..... 131/290, 291, 296, 297, 299, 300–310
See application file for complete search history.

(56) References Cited

U.S. PATENT DOCUMENTS

| | | | | |
|---|---|---|---|---|
| 2,419,109 | A * | 4/1947 | Berger et al. | 131/301 |
| 3,131,700 | A * | 5/1964 | Radwan | 131/301 |

(Continued)

FOREIGN PATENT DOCUMENTS

| | | |
|---|---|---|
| EP | 0 167 370 | 7/1984 |
| EP | 0 325 476 | 7/1989 |

(Continued)

OTHER PUBLICATIONS

EPOnline English Mechanical Translation of WO 02/058490, printed from http://translationportal.epo.org/emtp/translate/?ACTION=description-retrieval&COUNTRY=WO&FORMAT=docdb&KIND=A1&LOCALE=en_EP&Number=02058490&OPS=ops.epo.org&SRCLANG=de&TRGLANG=en&ENGINE=google on May 25, 2012.*

*Primary Examiner* — Richard Crispino
*Assistant Examiner* — Dionne Walls Mayes
(74) *Attorney, Agent, or Firm* — Fish & Richardson P.C.

(57) ABSTRACT

A process is provided for producing smokeless tobacco and/or snuff compositions using steam alone in an open vessel or in combination with pressure and venting to alter organoleptic properties of the smokeless tobacco and/or snuff compositions.

16 Claims, 2 Drawing Sheets

(56) References Cited

U.S. PATENT DOCUMENTS

| | | | | | |
|---|---|---|---|---|---|
| 3,704,715 | A | | 12/1972 | Buchmann et al. | |
| 3,931,825 | A | * | 1/1976 | DeCoursey | 131/301 |
| 4,044,780 | A | * | 8/1977 | Kelly | 131/303 |
| 4,146,040 | A | * | 3/1979 | Cohn | 131/349 |
| 4,355,648 | A | | 10/1982 | Bokelman et al. | |
| 4,388,932 | A | | 6/1983 | Merritt et al. | |
| 4,391,285 | A | | 7/1983 | Burnett et al. | |
| 4,407,306 | A | | 10/1983 | Hibbitts | |
| 4,485,829 | A | * | 12/1984 | Rainer et al. | 131/291 |
| 4,582,070 | A | | 4/1986 | Jewell | |
| 4,630,619 | A | | 12/1986 | Korte et al. | |
| 4,632,131 | A | | 12/1986 | Burnett et al. | |
| 4,766,912 | A | | 8/1988 | Hackman et al. | |
| 4,821,749 | A | | 4/1989 | Toft et al. | |
| 4,874,000 | A | | 10/1989 | Tamol et al. | |
| 4,880,018 | A | | 11/1989 | Graves, Jr. et al. | |
| 4,967,769 | A | | 11/1990 | Franklin et al. | |
| 4,984,587 | A | * | 1/1991 | Neville | 131/305 |
| 4,986,286 | A | | 1/1991 | Roberts et al. | |
| 4,989,620 | A | | 2/1991 | Keritsis et al. | |
| 5,005,593 | A | | 4/1991 | Fagg | |
| 5,074,319 | A | | 12/1991 | White et al. | |
| 5,099,862 | A | | 3/1992 | White et al. | |
| 5,161,548 | A | | 11/1992 | Neville | |
| 5,235,992 | A | | 8/1993 | Sensabaugh, Jr. | |
| 5,301,694 | A | | 4/1994 | Raymond et al. | |
| 5,318,050 | A | | 6/1994 | Gonzalez-Parra | |
| 5,360,022 | A | | 11/1994 | Newton et al. | |
| 5,372,149 | A | | 12/1994 | Roth et al. | |
| 5,445,169 | A | | 8/1995 | Brinkley et al. | |
| 5,497,792 | A | | 3/1996 | Prasad et al. | |
| 5,498,384 | A | | 3/1996 | Volk et al. | |
| 5,616,356 | A | | 4/1997 | Buhler et al. | |
| 5,676,164 | A | | 10/1997 | Martin | |
| 5,803,081 | A | | 9/1998 | O'Donnell, Jr. et al. | |
| 5,873,372 | A | | 2/1999 | Honeycutt et al. | |
| 6,048,404 | A | | 4/2000 | White | |
| 6,155,269 | A | | 12/2000 | Franke et al. | |
| 6,298,858 | B1 | | 10/2001 | Coleman, III et al. | |
| 6,425,401 | B1 | | 7/2002 | Williams | |
| 6,499,489 | B1 | | 12/2002 | Coleman, III | |
| 6,502,581 | B2 | | 1/2003 | Franke et al. | |
| 6,508,254 | B1 | | 1/2003 | Mua et al. | |
| 7,694,686 | B2 | * | 4/2010 | Atchley et al. | 131/296 |
| 2001/0000095 | A1 | | 4/2001 | Franke et al. | |
| 2002/0033182 | A1 | | 3/2002 | Ehling et al. | |
| 2002/0189624 | A1 | | 12/2002 | Pluckhahn et al. | |
| 2003/0000537 | A1 | | 1/2003 | Favaro | |
| 2004/0050398 | A1 | * | 3/2004 | Intorp et al. | 131/309 |
| 2004/0094175 | A1 | | 5/2004 | Zho et al. | |
| 2004/0112394 | A1 | | 6/2004 | Krukonis et al. | |

FOREIGN PATENT DOCUMENTS

| | | | |
|---|---|---|---|
| EP | 0 746 987 | | 12/1996 |
| EP | 1177730 | | 2/2002 |
| SE | 422 142 | | 2/1982 |
| WO | WO 02/058490 | * | 8/2002 |

* cited by examiner

CONDITIONING PROCESS FOR TOBACCO AND/OR SNUFF COMPOSITIONS

This application is a continuation of U.S. application Ser. No. 11/020,563, filed Dec. 22, 2004, which claims the benefit of U.S. Provisional Application Ser. No. 60/531,824, filed Dec. 22, 2003, which are applications incorporated herein by reference.

The present invention relates to a conditioning process for altering organoleptic properties of tobacco and/or snuff compositions. More particularly, a steam conditioning process in an open vessel is provided that includes applying steam alone or in combination with pressure to tobacco followed by venting. The steam and venting are effective for altering organoleptic properties of the tobacco and/or snuff products.

BACKGROUND

Smokeless tobaccos are products that are orally consumed without subjecting the product to combustion. These products are manufactured in a variety of forms including chewing tobacco, dry snuff and moist snuff. Generally, these types of products are made as follows with the steps being in no particular order: cutting or grinding the tobacco into a suitable size; dipping or spraying the tobacco with a casing solution; partially drying the cased tobacco; holding the tobacco in containers for a period of time; and packaging it.

Smokeless tobacco products may not have organoleptic properties that appeal to all consumers. In order to provide a variety of products with different taste characteristics, chewing tobacco and snuffs are often treated with a variety of flavors. However, the addition of flavors may not be appealing to certain consumers. Addition of flavors almost always requires other processing steps when producing the smokeless tobacco products. Accordingly, a need exists for a process that can produce a smokeless tobacco-based product that can provide oral tobacco satisfaction while altering, diminishing or eliminating the less desired taste characteristics sometimes associated therewith. Tobacco is further described in U.S. application Ser. No. 10/981,948 for "Nicotiana Compositions" and U.S. Ser. No. 10/982,248 for "Tobacco Compositions", both of which are incorporated herein by reference.

SUMMARY

The present invention is directed to the use of steam alone in an open vessel or in combination with pressure and venting to alter organoleptic properties of tobacco and/or snuff compositions. The tobacco and/or snuff compositions may be first processed in a low pressure preconditioning system that includes an open vessel. Alternatively, tobacco that is preconditioned or tobacco that has not been preconditioned may be processed in a pressure conditioning system.

A pressure conditioning system or low pressure, open vessel preconditioning system is provided for producing conditioned smokeless tobacco and/or snuff with improved organoleptic properties. Moistened tobacco and/or snuff is subjected to mechanical pressure and heating that is effective for macerating the tobacco. Steam, which can be injected, rapidly modifies and/or releases organoleptic compounds from the tobacco and/or snuff. Organoleptic compounds may be released from the tobacco and/or snuff with venting. The conditioned smokeless tobacco and/or snuff products have improved organoleptic properties as compared to smokeless tobacco and/or snuff products that have not been processed with the methods described herein.

In another aspect, tobacco and/or snuff may be processed in a system that includes multiples zones. In this aspect, temperature and pressure applied to the tobacco and/or snuff are increased with subsequent venting. Heating, pressurizing and venting cycles are repeated multiple times, preferably 2 to 3 times. Temperatures and pressures used in each cycle may be the same or may varied.

When multiple cycles of heating, pressurization and venting are conducted, tobacco and/or snuff is provided to a first extruder zone. The tobacco and/or snuff being conditioned has a moisture content of about 20 to about 25 weight percent and the first extruder zone has a temperature of about 120° F. to about 130° F. The tobacco is subsequently conveyed to a second extruder zone having a temperature of about 270° F. to about 280° F. The heating and conveying is effective for providing a pressure of about 130 to about 160 psi. Once a pressure of about 130 to about 160 psi is obtained, the pressure is vented. The tobacco may then be conveyed to a third extruder zone having a temperature of about 270° F. to about 300° F. The heating and conveying is effective for providing a pressure of about 160 to about 230 psi. Once a pressure of about 160 to about 230 psi is obtained, the pressure is vented. The tobacco may be further conveyed to a fourth extruder zone having a temperature of about 280° F. to about 300° F. and then conveyed to an extruder/die having a temperature of about 340° F. to about 350° F. The heating and conveying is effective for providing a pressure of about 200 to about 260 psi. Once a pressure of about 200 to about 260 psi is obtained, the pressure is released. The resulting tobacco and/or snuff product has a moisture content of 13.5 to 20 weight percent and a pH of 6.0 to 6.4.

Chewing tobacco and/or snuff having a moisture content of about 10 to about 30 weight percent may be used directly in the pressure conditioning process described herein. Alternatively, tobacco and/or snuff may be preconditioned in a low pressure preconditioning system. In this alternative aspect, tobacco and/or snuff is contacted with steam in an amount effective for raising the temperature of the tobacco and/or snuff to about 215° F. to about 230° F. Steam having a temperature of at least about 212° F. is contacted with tobacco and/or snuff for about 30 to about 60 minutes. Steam is allowed to freely vent from the tobacco and/or snuff. The resulting preconditioned tobacco has a moisture content of about 10 to about 30 weight percent. The preconditioned tobacco may be cooled and stored for future use without the pressure conditioning process or used directly in the pressure conditioning process.

DETAILED DESCRIPTION

Steam alone or steam in combination with pressure and venting are utilized to alter and release organoleptic properties from tobacco and/or snuff compositions As used herein, "organoleptic compounds" is meant to include carbohydrates, lipids, alkaloids, phenolics, diterpenes, and carotenoids.

The term "organoleptic properties" refers to the integrated sensory perception of the consumer that includes, for example, any combination of odor, aroma, fragrance, flavor, taste, or the like.

By "conditioning" is meant a process that modifies and/or releases organoleptic properties of the tobacco.

By "altered" is meant modified and/or released organoleptic properties.

By "steam" is meant water present in either a gaseous or superheated liquid state.

By "heated mechanical pressure" is meant exerting pressure and heat on tobacco by a mechanical device, preferably an extruder.

By "release" is meant any loss or modification of any organoleptic compounds from the tobacco. Release also includes, but is not limited to, extraction, volatilization, vaporization or otherwise carried, liberated or driven from the tobacco and/or snuff.

By "modify" is meant any change of the organoleptic properties of the tobacco through a physical or mechanical change that alters organoleptic properties thereof.

Tobacco

The tobaccos useful herein most preferably include cured (e.g., air cured), burley, dark, flue-cured, Maryland, oriental, and dark fired tobaccos. Other types of tobaccos such as the rare or specialty tobaccos also can be employed. The various tobaccos can be employed separately or as blends thereof.

The tobacco materials useful in this invention can vary. Typically, tobacco materials include whole leaf, tobacco fines, tobacco dust, sized tobacco lamina, cut or roll pressed tobacco stem, volume expanded tobacco, shredded tobacco, and the like as well as combinations thereof from various physical treatments. The tobacco may be processed, fermented or the like.

After selection of a tobacco, if desired, the tobacco can be subjected to a size reduction step using a ball mill or other suitable cutting apparatus.

Alternatively, the size reduction steps can be performed within the barrel of the extruder using a high shear screw element or shear producing screw element. The shredded tobacco may be processed to reduce particle sizes, such as by mechanically pressing tobacco through a series of mesh screens in order to process leaf material into uniformly sized particles, e.g., of less than 500 microns.

Before using the process of the present invention herein, the tobacco will be adjusted to a pH between 5 to 9, more preferably, pH 7 to 9. The moisture content of sized tobacco is adjusted to 3% to 50% moisture by weight, preferably 5% to 20% by weight.

Preconditioning/Steam Conditioning

Figure 1:
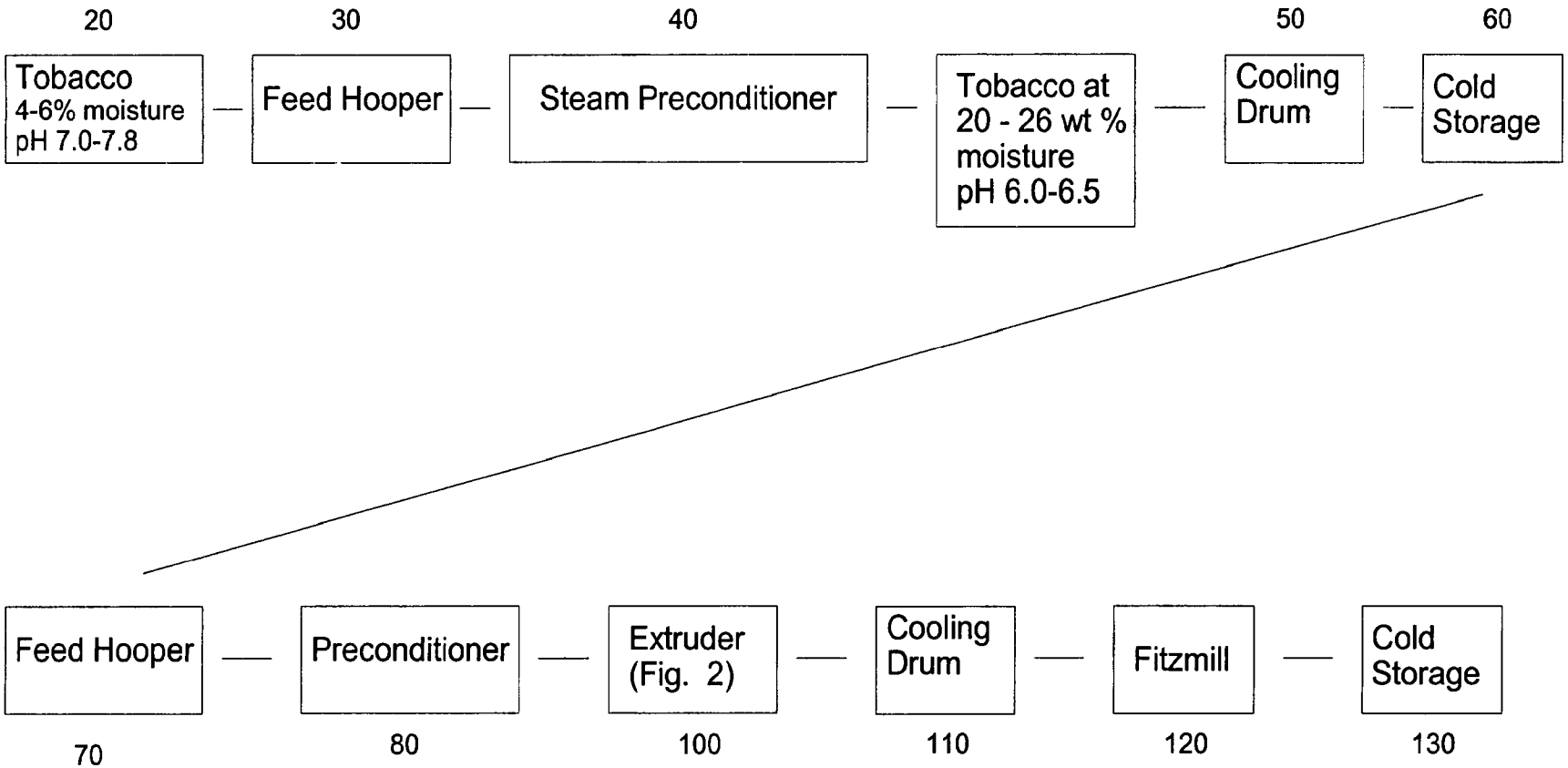
FIG. 1 illustrates a tobacco preconditioning process in combination with a pressure conditioning process.
Figure 2:
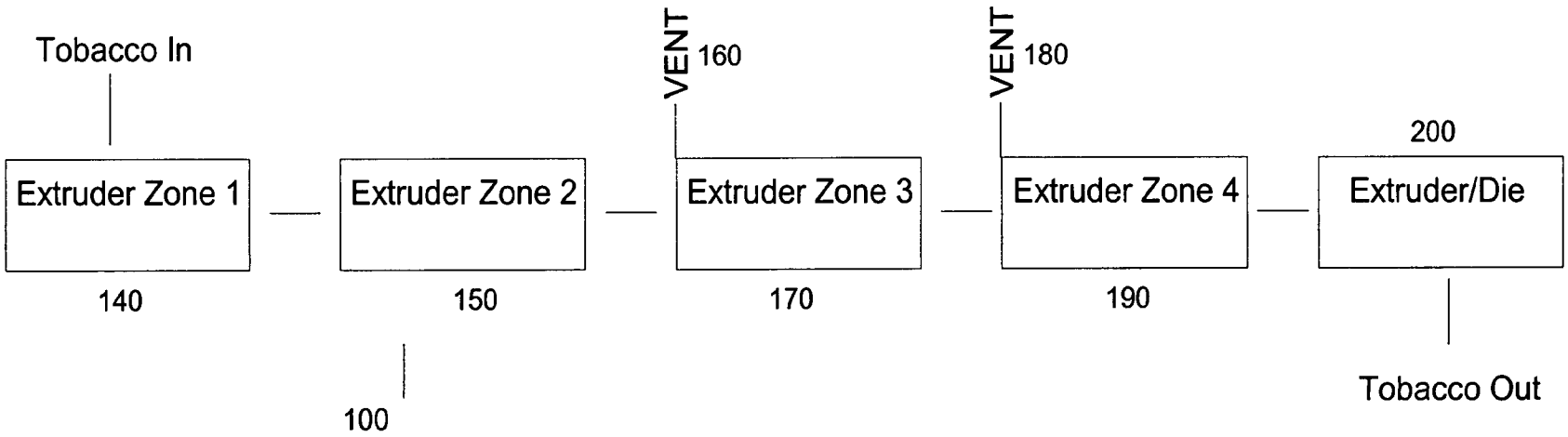
FIG. 2 illustrates a pressure conditioning process.

Tobacco and/or snuff may be preconditioned using a non-pressurized steam conditioning process prior to conditioning in a pressure conditioning process. As illustrated in FIG. 1, sized or processed tobacco with a moisture content of about 3 to about 10 weight %, preferably about 4 to about 6 weight %, and a pH of about 5 to about 9, preferably about 7.0 to 9.0, is transferred into feed hopper (30). The feed hopper (30) is effective for conveying an appropriate amount of tobacco, about 25 to about 60 pounds, preferably about 30 pounds, to a steam preconditioner (40). Larger amounts of tobacco can be preconditioned by using a larger vessel at equivalent ratios.

The steam preconditioner (40) is an open vented chamber. In the steam preconditioner (40) the tobacco and/or snuff is contacted with steam having a temperature at about 212° F. or higher, and more preferably at least 240° F. at a steam addition rate of about 80 to about 100 lbs/hr, preferably about 100 lbs/hr. During steam preconditioning, the tobacco and/or snuff is mixed to maximize contact with the steam and the amount used is sufficient to raise the temperature of the tobacco to about 215° F. to about 230° F. The mixing is performed using a single or double paddle mixer or the like. The time period within the conditioner is sufficient to provide for the modification or the release of organoleptic compounds from the tobacco. Typically the mixing time is between about 10 minutes and about 60 minutes depending upon temperature and amount of steam used. Gaseous components (e.g., water vapor, vaporized ammonia and organoleptic compounds) are freely vented in the venting region and can be sampled for analysis. As used herein, "low pressure" means that the preconditioning is freely vented. The steam conditioned tobacco may be cooled in cooling drum (50) to a temperature of about 80 to about 100° F. The tobacco and/or snuff may be put into cold storage (60) at a temperature of about 40° F. until further processing or may be used as desired.

Heated Mechanical Pressure Conditioning

The steam conditioned tobacco can be further processed using a heated mechanical pressure conditioning process such as, but not limited to, an extrusion process. Alternatively, the tobacco does not have to be steam conditioned and may be used directly in the pressure conditioning process. Tobacco and/or snuff being pressure conditioned should have a moisture content of about 5 to about 40 weight %, preferably 15 to about 50 weight %, and a pH of about 5.0 to about 9.0, preferably about 7.0 to about 9.0.

The mechanical pressure of the extruder (100) may be applied by using at least one interrupted, non-conjugated flights (shear-lock elements) or the like that act to impede the flow of tobacco within the extruder, forming a high-pressure region. If desired, employing a die at the end of the extruder may further increase extruder pressure. The pressures experienced within the extrusion means can vary and, in general, materials are processed above atmospheric pressure but below 2,500 psi, and preferably between 80 psi and 1500 psi.

In order to facilitate removal of released materials from the extruded tobacco, at least one venting region is formed consisting of lower pressure region that is downstream relative to the higher-pressure region upstream along the extruder (100). For example, the venting region can be maintained at or below atmospheric pressure by employing the use of vacuum venting. Such time periods can vary depending on the length of the extruder barrel and the extrusion conditions.

As illustrated in 1 and in more detail in 2, tobacco and/or snuff product is provided to a feed hopper (70) that feeds tobacco and/or snuff into the process at a constant rate of about 100 to about 260 lbs/hour, preferably about 200 lbs/hour. The feed hopper (70) conveys tobacco and/or snuff to a preconditioner (80) that acts as a conduit to provide tobacco and/or snuff to extruder (100). Tobacco and/or snuff is provided to extruder (100) at a rate of about 100 to about 260 lbs/hour, preferably about 200 lbs/hour.

A more detailed view of extruder (100) is shown if 2. In this aspect, tobacco first enters extruder zone 1 (140). Extruder zone 1 (140) is set at a temperature of about 125° F. to about 175° F., preferably about 150° F., which is effective to provide a barrel temperature of about 120° F. to about 130° F. Tobacco and/or snuff product will remain in extruder zone 1 (140) for about 1 to about 5 seconds.

Tobacco and/or snuff is conveyed from extruder zone 1 (140) to extruder zone 2 (150). Extruder zone 2 (150) is set at a temperature of about 300° F. to about 400° F., preferably about 350° F., which is effective to provide a barrel temperature of about 270° F. to about 280° F. Tobacco and/or snuff product will remain in extruder zone 2 (150) for about 5 to about 10 seconds.

At the end of extruder zone 2 (150) and the beginning of extruder zone 3 (170), pressure may be vented at vent (160). In this aspect, pressure at the end of extruder zone 2 (150) may reach pressures of about 130 to about 160 psi prior to venting at vent (160). Venting at vent (160) may be effected by venting to the atmosphere or with vacuum. A vacuum of about 8 to about 10 inches of Hg is utilized when vacuum venting is utilized at vent (160).

After venting at vent (160), tobacco and/or snuff may be conveyed to extruder zone 3 (170). Extruder zone 3 (170) is set at a temperature of about 300° F. to about 400° F., preferably about 350° F., which is effective to provide a barrel temperature of about 270° F. to about 280° F. Tobacco and/or snuff product will remain in extruder zone 3 (170) for about 5 to about 10 seconds.

At the end of extruder zone 3 (170) and the beginning of extruder zone 4 (190), pressure may be vented at vent (180). In this aspect, pressure at the end of extruder zone 3 (170) may reach pressures of about 160 to about 230 psi prior to venting at vent (180). Venting at vent (180) may be effected by venting to the atmosphere or with vacuum. A vacuum of about 5 to about 9 inches of Hg is utilized when vacuum venting is utilized at vent (180).

After venting at vent (180), tobacco and/or snuff may be conveyed to extruder zone 4 (190). Extruder zone 4 (190) is set at a temperature of about 300° F. to about 400° F., preferably about 350° F., which is effective to provide a barrel temperature of about 280° F. to about 300° F. Tobacco and/or snuff product will remain in extruder zone 4 (190) for about 10 to about 20 seconds. At the end of each zone, the tobacco may then be used or further processed through successive zones if desired.

Tobacco and/or snuff may be conveyed from extruder zone 4 (190) to and extruder/die (200). The extruder/die (200) is set at a temperature of about 350° F. to about 425° F., preferably about 400° F., which is effective to provide a barrel temperature of about 340° F. to about 350° F. Tobacco and/or snuff product will remain in the extruder/die (200) for about 15 to about 30 seconds. Pressure at the end of the extruder/die 200 may reach pressures of about 200 to about 260 psi prior to extrusion of materials. Upon extrusion, pressure is released from the tobacco and/or snuff composition.

The extruder (100) is effective for providing tobacco and/or snuff that is macerated under mechanical pressure and heat. Steam produced by the mechanical pressure and heat of the moistened tobacco and/or snuff in the extruder causes the modification or release of organoleptic compounds from the tobacco and/or snuff. If desired, steam or water may be supplemented upstream in the extruder process to raise the moisture content of the tobacco. Steam can be added in zone 1. Water can be added in zones 2-4, typically at about 1 to about 10% of the tobacco process flow rate.

The final moisture content of the tobacco exiting the extruder barrel can vary. Typically, the tobacco is processed such that the moisture content thereof upon exiting the extruder is at least 10% by weight percent and below 25% by weight percent. Preferably, the moisture content of the exiting tobacco is between 15% and 20% by weight. Typically, the temperature of tobacco exiting the extruder (100) is between about 120° F. and about 300° F.

The extruded tobacco can be passed through a die or conveyed out of the extruder barrel, and the resulting extrudate is collected. In this aspect, one useful die configuration is a 3 hole die having ⅛ inches holes. The manner in which the extrudate is collected can vary and depend on the desired use of the tobacco. If desired, the extrudate exiting the die can be subjected to treatment using a roller or cutting system, or to other physical treatments. Such optional physical treatment is particularly dependent upon the desired use of the extrudate or the intended final form of the manufactured product. For example, the tobacco base can be extruded in a granular or rope form, further processed, treated with additives, blended with other materials, cut or otherwise processed to achieve the desired size, or the like.

The extruders useful herein can vary. Preferred extruders are the twin-screw extruders of which the co-rotating twin-screw extruders are more preferred. Most preferred are the so-called "cooker extruders" which provide for heating of the materials that are introduced within the extruder. Various screw configurations can be employed. For example, screws having combinations of elements for feeding, mixing, pumping, shearing, and the like, can be selected as desired for optimum results. Screws having sections or elements which have interrupted or nonconjugated flights, or which are "counterflighted" or "reversing" also can be employed. Typical screw elements as well as screws having combinations of such elements are available from extruder manufacturers.

Suitable extruders are those means commercially available as Werner and Pfleider Continua 37 27:1 L/D, Wenger TX-57 34:1 L/D and Baker Perkins MPF-50/25:1 L/D. Operation of such extruders will be apparent to the skilled artisan.

As further shown in FIG. 1, materials leaving the extruder 100 can be further cooled in cooling drum 110 to a temperature of about 80° F. to about 100° F. Tobacco and/or snuff may be further sized in a Fitzmill 120 and then further stored in cold storage 130 at a temperature of about 40° F.

The following examples illustrate methods for carrying out the invention and should be understood to be illustrative of, but not limiting upon, the scope of the invention which is defined in the appended claims.

EXAMPLES

Example 1

Steam Conditioned Smokeless Tobacco

Tobacco with 4-6% moisture content is transferred into chamber that is freely vented to the atmosphere. In the chamber the tobacco is treated with steam having a temperature between 100° F. and 115° F. and at a steam rate of about 100 pounds per hour. During the steam processing, the tobacco is continuously mixed using a double paddle mixer for 30 minutes. The temperature of the tobacco reaches 110° F. during the steam conditioning. Steam and vaporized organoleptic compounds are vented from the chamber during the process. After completion the tobacco is cooled to room temperature. The final moisture content of the tobacco is about 25% by weight. Upon tasting the smokeless tobacco is found to have reduced bitterness and more favorable organoleptic properties.

Example 2

Heated Mechanical Pressure Conditioned Smokeless Tobacco

Tobacco having an approximately 20 weight % moisture content is metered at a rate of about 180 pounds per hour in a twin screw extruder, Wenger TX-57 34:1 L/D, with a die set-up. The barrel temperature of the extruder is between 51° F. and 176° F. and the screw speed is maintained at 110 rpm. The pressure at the shear-lock element is 250 psi while the vent vacuum is kept at 2-8 mm Hg. The temperature of tobacco exiting the extruder barrel is about 82° F. After cooling to room temperature, the moisture of the tobacco exiting the extruder barrel was 12%. Upon tasting the smokeless tobacco is found to have reduced bitterness and have more favorable organoleptic properties.

Example 3

Steam Conditioned and Heated Mechanical Pressure Conditioned Smokeless Tobacco

Tobacco with 5 to 6% moisture content is transferred into a chamber that is freely vented to the atmosphere. In the chamber the tobacco is treated with steam having a temperature between 100° F. and 115° F. and at a steam rate of 80 pounds per hour. During the steam processing, the tobacco is continuously mixed using a double paddle mixer for about one hour. The temperature of the tobacco reaches 110° F. during the steam conditioning. Steam and vaporized organoleptic compounds were vented from the chamber during the process.

The steam conditioned tobacco, with 30% moisture content, is metered at a rate of 180 pounds per hour in a twin screw extruder, Wenger TX-57 34:1 L/D. The barrel temperature of the extruder is between 51° F. and 176° F. and the screw speed is maintained at 110 rpm. The pressure at the shear-lock element is 100 psi while the vent vacuum is kept at 2-8 mm Hg.

The temperature of tobacco exiting the extruder barrel is about 82° F. After cooling to room temperature, the moisture of the tobacco exiting the extruder barrel is 22%.

Numerous modifications and variations in practice of the invention are expected to occur to those skilled in the art upon consideration of the foregoing detailed description of the invention. Consequently, such modifications and variations are intended to be included within the scope of the following claims.

What is claimed is:

1. A process for producing a steam conditioned tobacco and/or snuff composition comprising:

contacting tobacco and/or snuff with a gaseous composition comprising steam in a non-pressurized team preconditioner, wherein the steam is freely vented from the tobacco and/or snuff during said contacting step, wherein the steam raises the temperature of the tobacco and/or snuff to about 215° F. to about 230° F., and wherein the contacting step increases the moisture content of the tobacco and/or snuff, wherein the tobacco and/or snuff has a moisture content of about 5 to about 40 weight percent after said contacting step;

heating the steam conditioned tobacco and/or snuff at a moisture content of about 5 to about 40 weight percent in a mechanical extruder, the mechanical extruder having a temperature and conveyance rate effective for providing a pressure of at least about 130 psi; and venting the heated tobacco and/or snuff after attaining a pressure of at least about 130 psi to obtain a conditioned smokeless tobacco and/or snuff.

2. The process of claim 1, wherein the duration of said contacting step is 10 to 60 minutes.

3. The process of claim 1, wherein the tobacco and/or snuff is mixed in mixer during said contacting step.

4. The process of claim 1, further comprising the step of cooling the tobacco and/or snuff to a temperature of about 80° F. to about 100° F. after said contacting step.

5. The process of claim 1, wherein the tobacco and/or snuff has a moisture content of between 3 and 10 weight percent prior to the contacting step.

6. A process for producing a steam conditioned tobacco and/or snuff composition comprising:

contacting tobacco and/or snuff with a gaseous composition comprising steam in a non-pressurized steam preconditioner, wherein the steam is freely vented from the tobacco and/or snuff during said contacting step, wherein the steam raises the temperature of the tobacco and/or snuff to about 215° F. to about 230° F., and wherein the contacting step increases the moisture content of the tobacco and/or snuff, wherein the tobacco and/or snuff prior to said contacting step is at a pH of about 7.0 to about 9.0, wherein the duration of said contacting step is 10 to 60 minutes;

heating the steam conditioned tobacco and/or snuff at a moisture content of about 5 to about 40 weight percent in a mechanical extruder, the mechanical extruder having a temperature and conveyance rate effective for providing a pressure of at least about 130 psi; and venting the heated tobacco and/or snuff after attaining a pressure of at least about 130 psi to obtain a conditioned smokeless tobacco and/or snuff.

7. The process of claim 6, wherein the tobacco and/or snuff has a moisture content of about 5 to about 40 weight percent after said contacting step.

8. The process of claim 6, wherein the tobacco and/or snuff has a moisture content of about 15 to about 50 weight percent after said contacting step.

9. The process of claim 6, further comprising the step of cooling the tobacco and/or snuff to a temperature of about 80° F. to about 100° F. after said contacting step.

10. The process of claim 6, wherein the venting step after attaining a pressure of at least about 130 psi is carried out at atmospheric pressure.

11. The process of claim 6, wherein the venting step after attaining a pressure of at least about 130 psi is carried out under a vacuum, wherein the vacuum is about 5 to about 10 inches of Hg.

12. The process of claim 6, wherein the tobacco and/or snuff has a moisture content of about 3 to about 10 weight percent prior to said contacting step and a moisture content of about 15 to about 50 weight percent after said contacting step.

13. The process of claim 6, wherein the contacting step lasting for 10 to 60 minutes.

14. A process for producing a steam conditioned tobacco and/or snuff composition comprising contacting tobacco and/or snuff with a gaseous composition consisting essentially of steam in a non-pressurized steam preconditioner, wherein the steam is freely vented from the tobacco and/or snuff during said contacting step;

heating the steam conditioned tobacco and/or snuff at a moisture content of about 5 to about 40 weight percent in a mechanical extruder, the mechanical extruder having a temperature and conveyance rate effective for providing a pressure of at least about 130 psi; and venting the heated tobacco and/or snuff after attaining a pressure of at least about 130 psi to obtain a conditioned smokeless tobacco and/or snuff.

15. The process of claim 14, wherein the venting step after attaining a pressure of at least about 130 psi is carried out at atmospheric pressure.

16. The process of claim 14, wherein the venting step after attaining a pressure of at least about 130 psi is carried out under a vacuum, wherein the vacuum is about 5 to about 10 inches of Hg.

* * * * *

UNITED STATES PATENT AND TRADEMARK OFFICE

CERTIFICATE OF CORRECTION

PATENT NO. : 8,807,141 B2
APPLICATION NO. : 12/719201
DATED : August 19, 2014
INVENTOR(S) : James C. Breslin et al.

It is certified that error appears in the above-identified patent and that said Letters Patent is hereby corrected as shown below:

On the Title Page

Column 1, Line 3, please delete "Jerry B. Eilliot," and insert -- Jerry B. Elliot, --, therefor.

In the Claims

Column 7, Line 40 (Claim 1), please delete "team" and insert -- steam --, therefor.

Signed and Sealed this
Eighteenth Day of November, 2014

Michelle K. Lee

Michelle K. Lee
*Deputy Director of the United States Patent and Trademark Office*